US008035510B2

(12) United States Patent
Pfafman et al.

(10) Patent No.: US 8,035,510 B2
(45) Date of Patent: Oct. 11, 2011

(54) ASSET RECOVERY DEVICE INSTALLATION AND ALERT SYSTEM

(75) Inventors: Timothy Pfafman, Truckee, CA (US); Roger Hayward, Long Beach, CA (US); Richard Fuller, Gilroy, CA (US)

(73) Assignee: 3SI Security Systems, Inc., Exton, PA (US)

( * ) Notice: Subject to any disclaimer, the term of this patent is extended or adjusted under 35 U.S.C. 154(b) by 313 days.

(21) Appl. No.: 12/121,745

(22) Filed: May 15, 2008

(65) Prior Publication Data

US 2009/0284367 A1 Nov. 19, 2009

(51) Int. Cl.
*G08B 1/08* (2006.01)

(52) U.S. Cl. ..... 340/539.13; 340/539.1; 340/573.1; 340/572.1; 342/463

(58) Field of Classification Search ..... 340/686.1, 340/572.1, 573.1, 539.13, 539.1; 455/404.2, 455/404.1, 456.1, 456.3, 550.1; 370/338; 700/65; 707/24; 342/463
See application file for complete search history.

(56) References Cited

U.S. PATENT DOCUMENTS

| | | | | |
|---|---|---|---|---|
| 4,855,713 | A * | 8/1989 | Brunius | 340/506 |
| 5,091,713 | A * | 2/1992 | Horne et al. | 340/541 |
| 6,801,129 | B2 * | 10/2004 | Grimm | 340/568.7 |
| 7,171,187 | B2 * | 1/2007 | Haave et al. | 455/404.2 |
| 7,183,915 | B2 * | 2/2007 | Bartholf et al. | 340/570 |
| 2001/0040506 | A1 * | 11/2001 | Boulay et al. | 340/539 |
| 2003/0179140 | A1 * | 9/2003 | Patterson et al. | 342/463 |
| 2003/0206117 | A1 * | 11/2003 | Rosenberg et al. | 340/932.2 |
| 2005/0017900 | A1 * | 1/2005 | Grimm | 342/357.07 |
| 2005/0073406 | A1 * | 4/2005 | Easley et al. | 340/539.1 |
| 2005/0128074 | A1 * | 6/2005 | Culpepper et al. | 340/539.1 |
| 2005/0246094 | A1 * | 11/2005 | Moscatiello | 701/207 |
| 2006/0158328 | A1 * | 7/2006 | Culpepper et al. | 340/539.13 |
| 2006/0238347 | A1 * | 10/2006 | Parkinson et al. | 340/572.4 |
| 2006/0290491 | A1 * | 12/2006 | Wagner et al. | 340/539.26 |
| 2007/0081540 | A1 * | 4/2007 | Crowell et al. | 370/395.1 |
| 2007/0159343 | A1 | 7/2007 | Crucilla | |
| 2007/0222595 | A1 * | 9/2007 | Motteram et al. | 340/572.1 |
| 2007/0273514 | A1 * | 11/2007 | Winand et al. | 340/572.1 |
| 2008/0068157 | A1 | 3/2008 | Ikemori et al. | |
| 2008/0075235 | A1 * | 3/2008 | Russikoff | 379/45 |
| 2008/0085706 | A1 | 4/2008 | Nagata et al. | |
| 2008/0088438 | A1 * | 4/2008 | Aninye et al. | 340/539.13 |

(Continued)

FOREIGN PATENT DOCUMENTS

EP 1916850 A1 4/2008

(Continued)

OTHER PUBLICATIONS

PCT search report, Jul. 7, 2009 for PCT/US2009/044037.

(Continued)

*Primary Examiner* — George A Bugg
*Assistant Examiner* — Hoi C Lau
(74) *Attorney, Agent, or Firm* — RatnerPrestia

(57) ABSTRACT

In one embodiment, a method is provided for selectively providing an alert to a user of a tracked asset in an asset recovery system. The method includes activating a tracking device on the tracked asset to generate a report, evaluating the report and a condition based on a home location assigned to the tracking device for generating an alert, creating the alert based on the evaluation of the condition and the report, and sending the alert to the user.

23 Claims, 7 Drawing Sheets

U.S. PATENT DOCUMENTS

| | | | | |
|---|---|---|---|---|
| 2008/0106399 | A1 | 5/2008 | Yaqub et al. | |
| 2008/0186163 | A1 * | 8/2008 | Mills | 340/539.13 |
| 2010/0176950 | A1 * | 7/2010 | Bartholf et al. | 340/572.7 |

FOREIGN PATENT DOCUMENTS

| | | | |
|---|---|---|---|
| EP | 2 209 097 | A1 | 7/2010 |
| GB | 2 442 798 | A | 4/2008 |
| WO | 2006121930 | A2 | 11/2006 |
| WO | WO 2009/140552 | A1 | 11/2009 |

OTHER PUBLICATIONS

Sgura, Salvatore, "Extended European Search Report," Apr. 6, 2010, 6 pgs., for EP Application corresponding to WO 2009/140552.

de la Cruz Valera, "Written Opinion of the International Searching Authority," Jul. 7, 2009, 5 pgs., for PCT Application corresponding to WO 2009/140552.

* cited by examiner

ASSET RECOVERY DEVICE INSTALLATION AND ALERT SYSTEM

TECHNICAL FIELD

The present disclosure relates generally to asset tracking and recovery. More particularly, the present disclosure relates to systems and methods to simplify the integration and servicing of tracking device on tracked asset and to improve the monitoring and alerting of tracked asset for its recovery.

BACKGROUND

There have been many devices and systems developed that are geared to the protection and recovery of valuable assets. Among the most novel of these are those used for the protection of currency and other small high-value objects such as jewelry where the recovery device is embedded directly into the object that is being protected.

There are numerous methods available for protecting high-value assets such as currency at a banking establishment. These include but are not limited to: 1) training; 2) surveillance cameras; 3) reward program; 4) unarmed guards; 5) police tellers; 6) off-duty police officers; 7) bandit barriers; 8) bait money; and 9) explosive devices and tracking systems. Training is the cornerstone to robbery prevention and safety. By maintaining proper security protocols, cash control (to minimize cash loss) and safety precautions, bank personnel can be the most instrumental in robbery avoidance and, in the case where a robbery takes place, apprehension of the criminal. Surveillance cameras placed throughout a bank branch are usually employed as an apprehension tool although there may be some unquantified deterrent effect, especially in the queue line. Given the prevalence of surveillance cameras it sometimes serves as the only record of the bank robbery and the only evidence for the police to use to identify the thief. It is a standard policy for many industries with highly valuable assets to offer a reward program to provide a reward if a robber is identified. Several instances have been reported where a person involved in a robbery actually knew the robber and the reward system helps encourage witnesses to come forward. Unarmed security guards are used primarily as deterrents to robbers for banks and other institutions. During an incident they are instructed primarily to "observe and report". Chances are that the presence of a security guard in a location will redirect the robber to go to another location without a guard. Police tellers are used by banks in particular to "observe and report" during an incident but unlike a security guard they are trained as full tellers and work in plain clothes. They are off-duty police officers and hired at a police salary rate. They share the same service and sales responsibilities as regular tellers. They are commonly used in frequently robbed locations. Off-Duty police officers are sometimes used as armed guards for locations with substantial robbery problems. A good source of personnel for this is the local police department. If not possible, a security firm made up of retired police is a good source for well-trained armed personnel. This can be a very expensive undertaking. Bandit barriers are permanent, bullet-proof shields between assets being protected and the robber. These have been particularly effective in locations where other methods like guards have proven ineffective as a deterrent. With an initial cost of about $1,000 per linear foot, setup is high. The payback for such an investment is first the savings in cash from a frequently robbed location. Also there is the added benefit of avoiding associated costs from a robbery such as lost time and teller fatigue and turnover. Bait money is a cash reserve in a teller's drawer with pre-recorded serial numbers to be handed out in case of a robbery. If the robber is apprehended the serial numbers can be used to trace it back to a particular robbery and aid in conviction. This is purely a method for identification after apprehension.

Banks also use explosive devices and tracking systems both for apprehension (and recovery) as well as prevention. They can be used in prevention when word is leaked that these devices are used in a particular area. It is stressed that training in this case is critical because many bank robbers present instructions to not pass "bait money or dye packs" since knowledge of these methods are apparently fairly well known. Each bank establishes their own policies and methods for training and passing these devices to a robber. The dye pack was invented to stain stolen currency in a manner that "renders a bank robbery pointless" as taught by Robeson (U.S. Pat. No. 3,564,525) and Howett (U.S. Pat. No. 1,923,979). It does this by exploding a colored dye that stains the money, making it obvious that it has been involved in a robbery. In some devices, tear-gas is included in the dye to not only mark the presence of the stolen currency but also show a colored cloud for searching by law-enforcement. A dye pack consists of a hollowed-out stack of real bills with chemicals and electronics inside, usually with one or two bills stuck on the top and bottom of the stack. The dye pack sits idle in "safe mode" while in the teller drawer on a magnetic plate until a robbery occurs. During the robbery the teller is supposed to subtly slip the device in with other money. Removing the device from the magnetic plate does not cause the dye to be released; it is simply armed at that point. When the bank robber passes a radio activation field near the front door the device is programmed to start a timer for later release, allowing time for the bank robber to get some distance from the bank before the money is stained. In many cases the hands and/or clothing of the bank robber are stained making identification easier. Initially these devices were rigid but development in electronic design have allowed for the device [Keniston, S. E., "Bendable currency security dye pack", U.S. Pat. No. 5,196,828] and even the chemical pouches [Keniston, S. E., "Bendable currency security dye pack", U.S. Pat. No. 5,485,143] to be flexible, thus allowing them to be passed during a robber with low chance of detection by the robber (who is often an "amateur"). An alternate activation method would be to have a local RF transmitter near the pack to keep it inactive. When an adequate distance is achieved between the pack and the RF transmitter, and the pack is no longer sensing the RF signal, the pack would activate. While a very useful tool, it has to be noted that this type of device is explosive and requires special handling. For that reason some banks have not adopted this technology to protect their employees and customers.

The other prevalent in-drawer cash protection system employed by banks is the miniature RF beacon. As in the case of the dye pack it sits idle in the teller drawer until activated by lifting off of a magnetic plate. Local receiving towers in the proximity of the bank pick up the small RF transmission of the device [Allen, M. F., "ELECTRONIC DETECTION AND TRACING MEANS", U.S. Pat. No. 3,618,059]. This would immediately start the transmission of a signal received by a network of stations located through a city both near the bank and along likely escape routes for the robber. The police could also be equipped with receivers to tell if they are close to the stolen currency pack. Later refinements allowed the pursuers to not only determine they are close, but also determine range and direction to the stolen device [Culpepper, J. W., Currie, H. A.; Heathcock, W. F., "Beacon tracking system", U.S. Pat. No. 4,021,807]. While the transmission device in the cash can be extremely small, one of the most significant limitations to this technology is the requirement for receiver stations to be placed around the area of operation. If the device should get outside of the installation region, it can no longer be tracked. To cover the whole lower-48 states of the US, assuming a 5-mile radius of receiver coverage would take a minimum of 40,000 stations (excluding line-of-sight issues that would substantially increase the number of stations). It is probably financially impossible to place receiving stations throughout the country for a single application. Therefore it is likely that only local areas will be covered which leaves the system vulnerable to coverage gaps.

As an augmentation to the miniature RF-beacon approach, Grimm (U.S. Pat. No. 6,801,129) proposed using a cellular data transmission system transmitting location information from a Global Positioning System receiver. The Global Positioning System (or GPS as it is commonly known) is comprised of a number of satellites circling the Earth that radiate timing signals that are controlled by a network of ground stations. By measuring the arrival of these signals at a receiver, it is possible to determine the location of the receiver to very high precision. While Mohan (U.S. Pat. No. 6,121,922) teaches the combined use of GPS and a mobile transmitter in a compact form-factor, Grimm extended this concept to include a RF beacon that allowed for the local isolation of stolen device with far greater precision than can be achieved with a cellular network location or GPS position fix. U.S. Pat. Nos. 6,665,613, 6,480,147, 6,271,757 teach different variations of defining regions within a tracking device which upon the device getting a GPS location (or any kind of position determination) outside of the region certain actions will occur including, but not limited to, reporting to a network, sending alerts, or sounding an alarm. All these patents teach that there is some alarm mechanism in which some security organization or law enforcement agency can be alerted to a theft of the asset under protection by the tracking device. However, none of these references teaches how such a device came to be installed at a particular fixed location and how a device is associated with a law enforcement agency in a given jurisdiction. It is unclear if these devices were pre-programmed at the factory to be matched with their end location. Since security or law-enforcement agencies need to respond to a particular location (for example, a specific bank branch involved in a robbery), it is clear that some relationship existing between the asset tracking and the location must be established but no information is given on this method or system. These patents also do not teach how these security devices could be serviced and tested without sending non-robbery related alerts to security or law enforcement and they do not teach how unintentional activations not related to a theft could create selective alerts to support personnel but not result in an alarm going to the police. Alternatively, U.S. Pat. Nos. 7,292,159, 7,283,047, 7,283,046, 7,138,914 teach that service and maintenance records can be kept on a central server for update or later recall. However, none of them teaches how alerting can be averted or changed based on servicing at a specific location. The cost of police and other law enforcement responding to false alarms continues to be high. Many municipalities have enacted ordinances to charge owners of alarm systems the cost to respond to alerts that are not tied to an active burglary or crime. Some cities have stopped responding to automated alerts altogether.

The sequence of events in a robbery are: 1) the initial assault, device activation and transfer to robber; 2) robber egress; 3) activation and notification to server; 4) server processing; 5) alert processing; 6) law enforcement, police and security dispatch; 7) RF beacon co-location; 8) suspect isolation; and 9) suspect apprehension and recovery. The critical aspect is that this is a system. Many elements act in concert to make the recovery possible. Careful planning and cooperation of multiple organizations are necessary for ultimate success. Having multiple inadvertent alerts go from a bank (or similar installation of a valuable asset) to law enforcement (or similar private security firm) can reduce effectiveness by increasing response time and possibly costs because of fees responding to false alarms.

The design of the system needs to be near-real-time to enable pursuit by police and other law enforcement agencies such as the FBI. Latencies from the measurement of location and velocity to the display at the tracking site of a minute or more could allow for enough separation in a chase to confuse the pursuers. Tests conducted in trials indicated a delay of 15 seconds or less was required. This provided an extremely short timeline to send location information to some central location then disseminate it to the necessary law-enforcement officers. Communication channels would have to be chosen to ensure that controlled (or at least reliable) latency could be maintained.

It is understood by the one skilled in the art that GPS represents a larger set of Global Navigation Satellite Systems or GNSS that are currently fielded and under planning such as GLONASS in Russia, GALILEO in Europe, Beidou in China as well as others.

SUMMARY

Methods and systems are disclosed for creating and directing alerts to different groups and individuals with separate relationships and responsibilities for a tracking device associated with an asset.

In accordance with an example of the present disclosure a device or devices can be configured automatically to be matched with a specific fixed install location (install mode). By installing device in batches, completely selected in the field, the main office or distribution center does not have to pre-assign a device to the location and any device failures can just be replaced in the field, on-the-fly. Additionally this allows for an end-to-end test of the device's tracking capabilities before completion of installation at the location, giving alerts and feedback to installation personnel without alerting security personnel.

In accordance with another example of the present disclosure, a remote monitoring station continuously checks last reported precise location (determined from GPS or equivalent accuracy) of the tracked unit using a multi-stage alerting mechanism; a first alert stage where a certain number of observers of the unit receive activity information and alerting and at least one other alert stage where an additional set of observers are notified of activity or alerts. Specifically the "first set of observers" are the owners of the tracking device and/or a monitoring company. The "additional set of observers" are recovery specialists, police or other law enforcement agencies. Having this multi-tier alerting system helps avoid inadvertent activation alerts to police which can strain the relationship between the owners of the tracked device and the police who respond to alarms.

These and other objects and advantages of embodiments of the present disclosure will be more fully understood by reference to the following detailed description when considered in conjunction with the following drawings.

DETAILED DESCRIPTION

Figure 1:
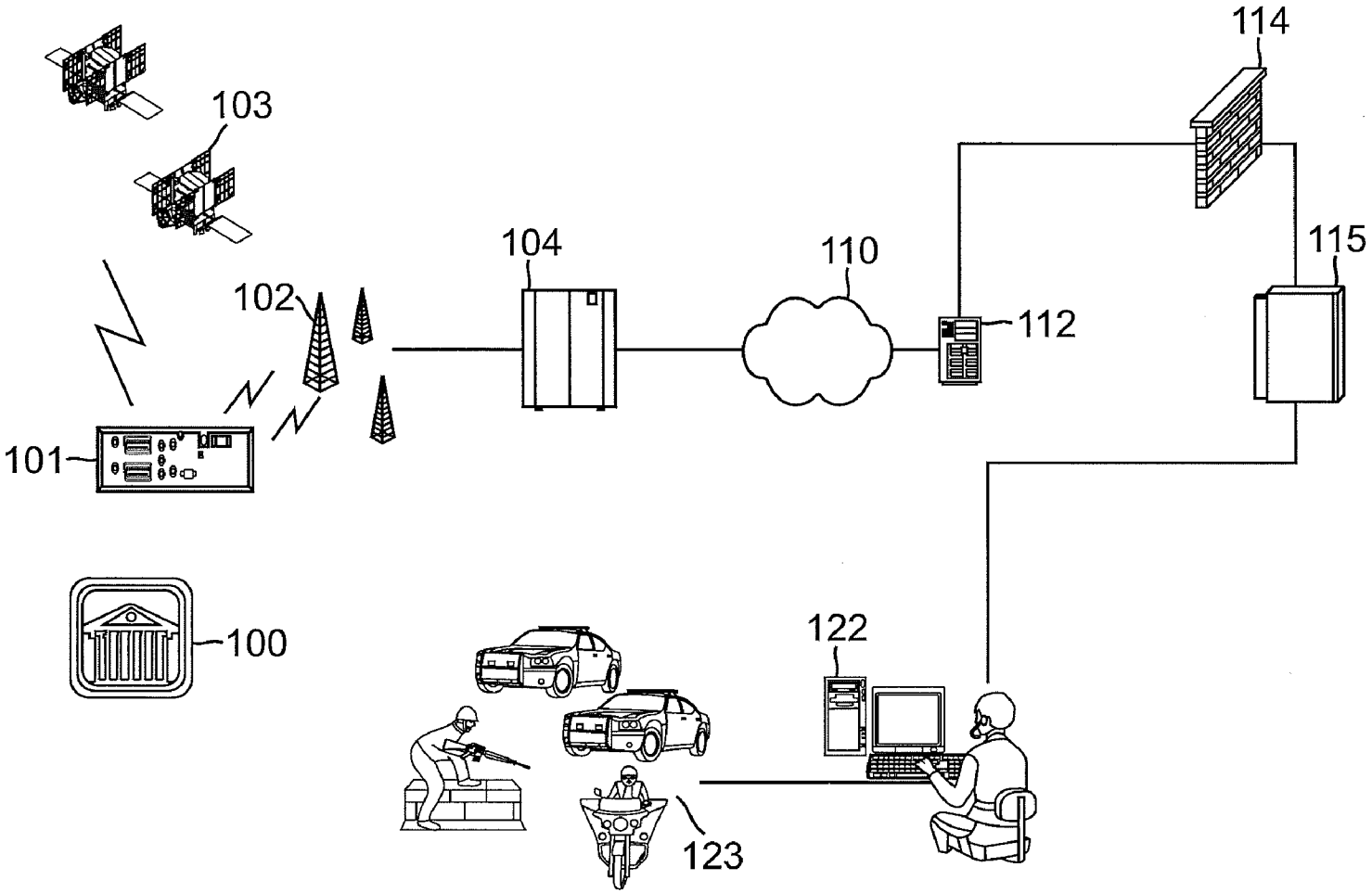
FIG. 1 is an overview of an asset tracking and recovery system according to one or more exemplary embodiments of the present disclosure.

FIG. 1 is an overview of an asset tracking and recovery system comprising a tracking device (101), GPS satellites (103) used for precise location determination by the tracking device, a cellular data network (102) for the tracking device to communicate its location information, and a server (115) that receives, stores and provides location information as well as provides alerts to a security or law enforcement agencies (123) to track and recover the stolen device according to one or more exemplary embodiments of the present disclosure. The tracking device (101), after installation onto an asset to be tracked, is associated with a fixed location (100) such as a bank. The fixed location (100) may be a geographical region defined by any number of means including a box, a circle or other polygon shape enclosing some central point. The shape may even be formed from the diagram of the floor plan of the location under consideration. Besides a physical boundary the fixed location (100) may have other properties, including properties inherited from a group with which the fixed location (100) is associated. When activated, the tracking device (101) will send data via the local cellular tower (102), through a switch (104), a communications backbone (110), a gateway (112), a protective firewall (114) to the server (115). Thus, the tracking device (101) is monitored by the server (115) which collects location and status information from the tracking device and stores that information in a database that authorized personnel may recall either in real-time or after the fact (122).

Figure 2:
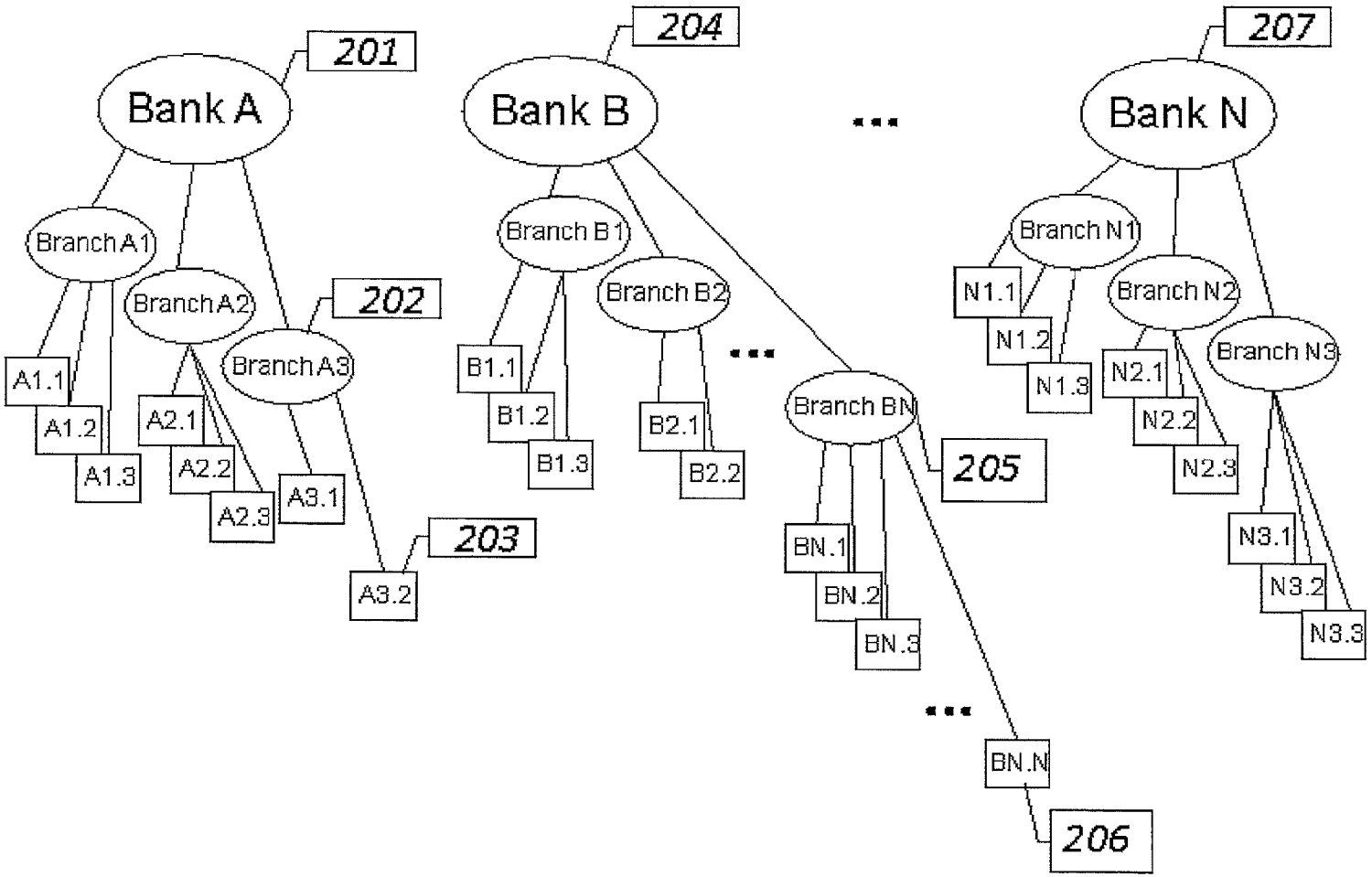
FIG. 2 is a diagram showing the relationship between groups and devices according to one or more exemplary embodiments of the present disclosure.

Referring to FIG. 2, there is shown a relationship between groups (201,202,204,205,207) and tracking devices (203,206). A group determines who "owns" a particular location and the tracking devices associated with that location. A tracking device can belong to only one "owner" group, For example tracking device A3.2 (203) belongs to its owner group Branch A3 (202), and not to any other owner group. Similarly, a group may belong to only one other group. For example, group Branch A3 (202) belongs to group Bank A (201), not to group Bank B (204). However, other group or groups may have access to a tracking device provided they are accessor or accessors to the owner group of the tracking device. Tracking device belonging to an owner group inherits properties associated with that owner group. This way, multiple tracking devices may be easily configured and deployed by inheriting properties such as location information associated with their common owner group.

Figure 3:
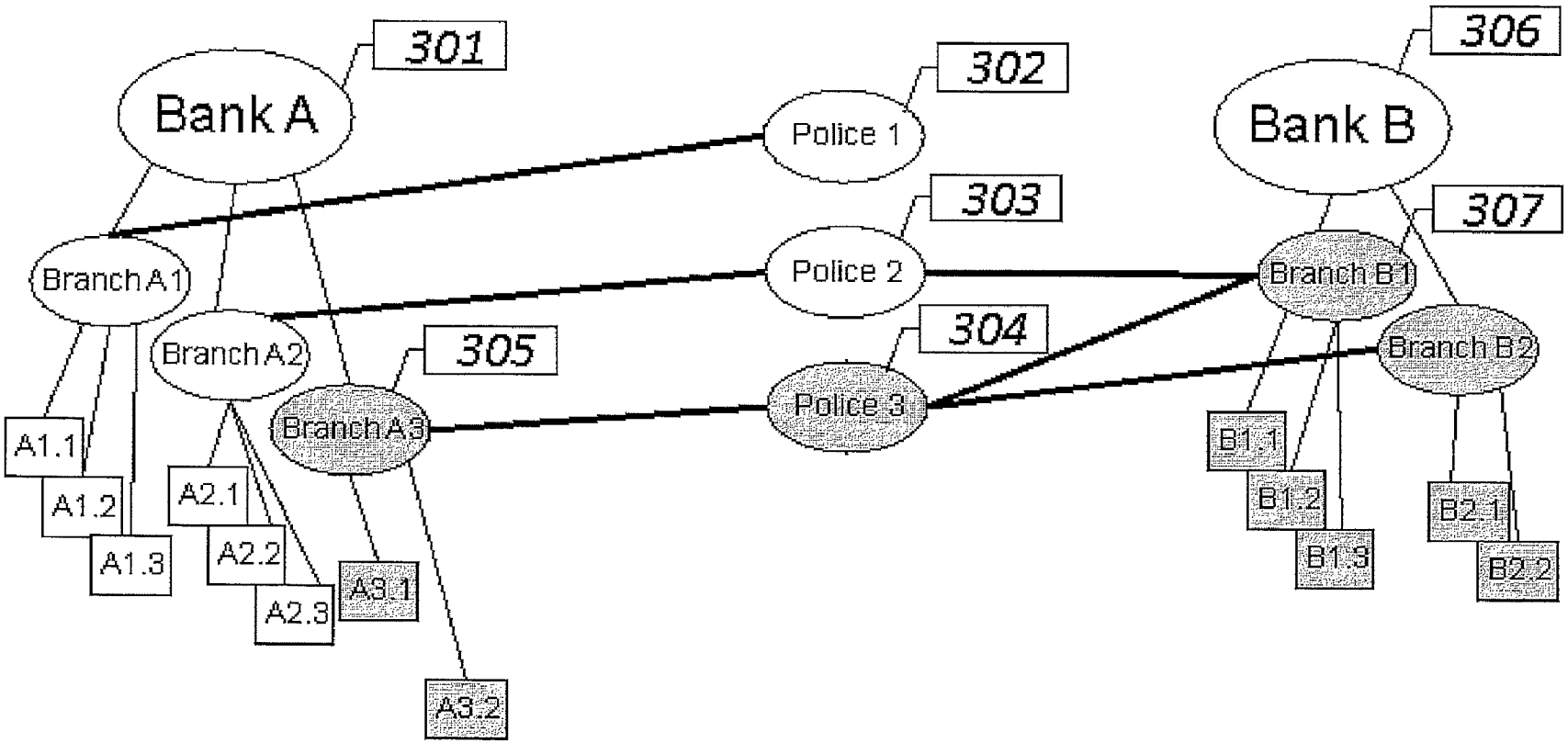
FIG. 3 is a diagram showing how law enforcement or security agencies can have access to devices on a selective basis according to one or more exemplary embodiments of the present disclosure.

Referring to FIG. 3, there is shown how police (or other law enforcement or security agencies) may have access to tracking devices on a selective basis depending on how their accessor properties are established. It shows that a group may be an accessor group such as a law enforcement agency that may have jurisdiction over that particular location. For example, a group Police 3 (304) may see the devices at Branch A3 (305) but not at the rest of the branches for Bank A (301). This allows the law enforcement groups to be assigned only to those locations that are within their jurisdiction.

Figure 4:
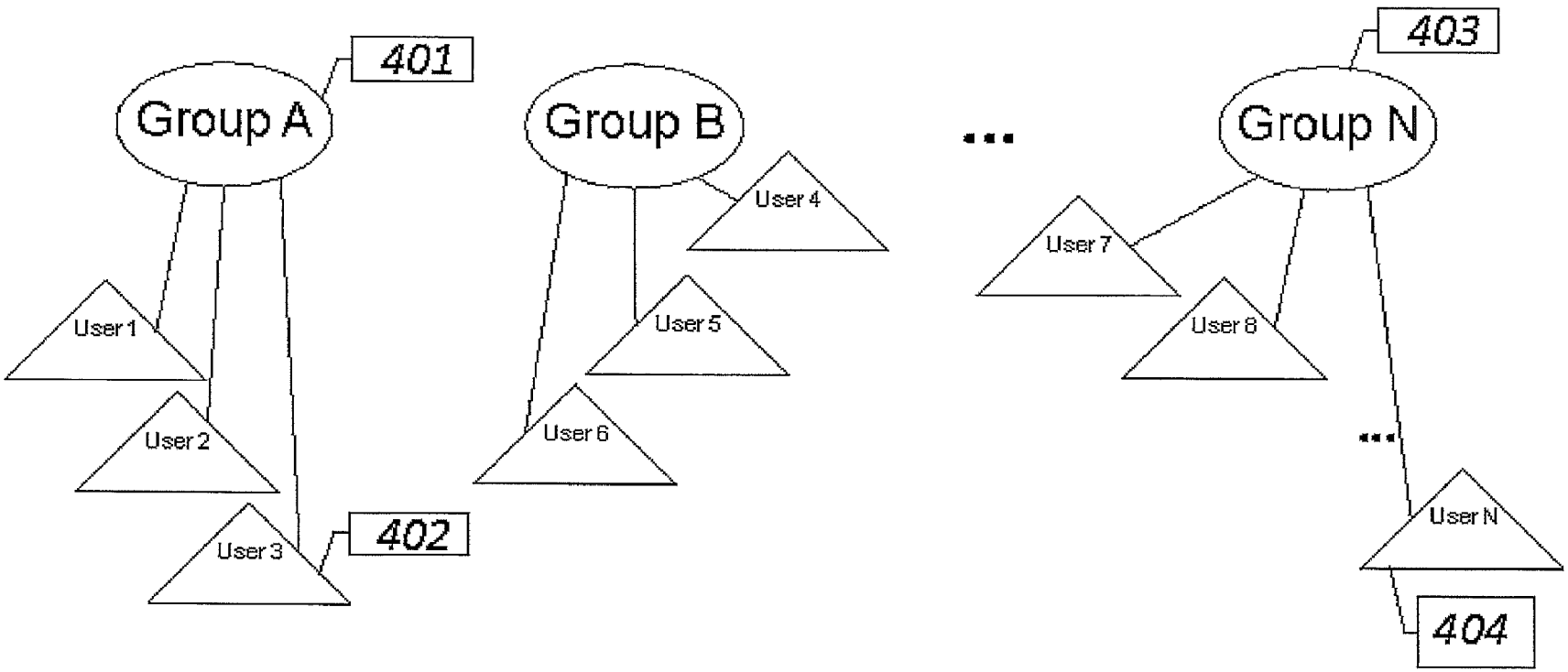
FIG. 4 is a diagram showing the membership of users in a group according to one or more exemplary embodiments of the present disclosure.

Referring to FIG. 4, there is shown a membership of users in a group. A user is an entity that has access to the server. With access to the server the user can receive location updates from activated devices on a web browser or mobile data device. Additionally the user can receive alerts either in a web browser, via instant message (IM), via a cell phone, on a pager, on a wirelessly enabled PDA or in a dedicated alert application or applet running on a personal computer or web terminal. User can set properties and preferences for alerts such as destination addresses for alerts. User can also select the type of alerts it can see such as alerts activated during installation or those activated by the tracked asset leaving a fixed location. Like a tracking device, a user can belong to only a single group. However, the group that the user belongs to can be an accessor group to multiple groups and thus would gain access to tracking devices of multiple groups. Associating multiple users with an owner group allows a multi-stage alerting mechanism; a first alert stage activated by tracking device within a group may only be received by users with their properties enabled to see the first alert. Additional set of users may be notified only when the alert has been verified to be a real alert or upon satisfaction of other conditions. Having this multi-tier alerting system helps avoid inadvertent activation alerts to the users in the second group such as police.

Figure 5:
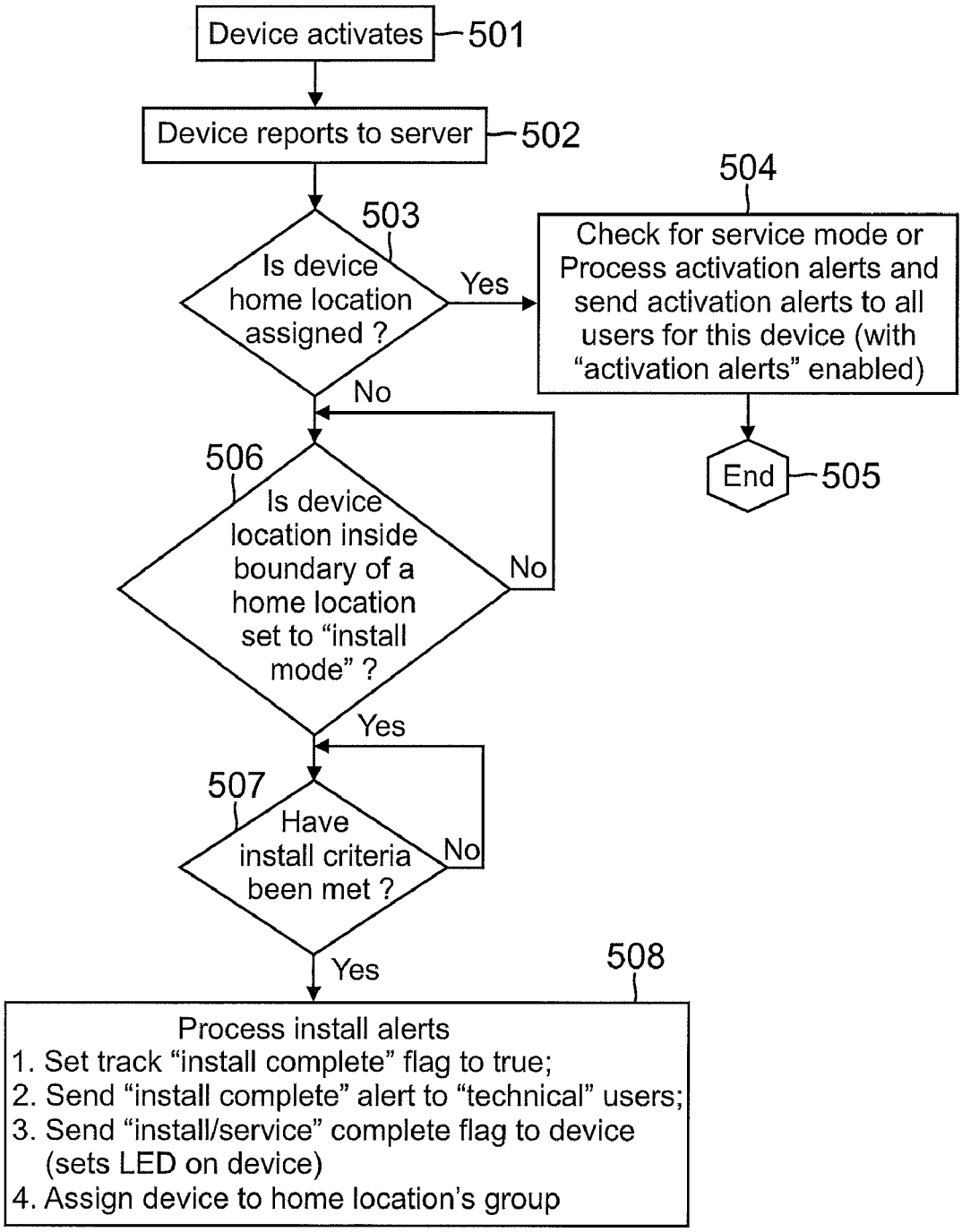
FIG. 5 is a flowchart outlining the "install mode" logic according to one or more exemplary embodiments of the present disclosure.

Referring to FIG. 5, there is shown a flowchart of an install mode for installation of a tracking device. A field service technician is typically sent a number of tracking devices to install to assets associated with a fixed location. The fixed location may be a bank, or it may be any location with high-value assets to be tracked. The asset to be embedded with the tracking device may be a stack of bills at a bank, a jewelry box in a jewelry store, a case of pharmaceuticals at a pharmacy, or a piece of construction equipment at a construction site. When a tracking device is to be installed to an asset at a location, the location is set to "install mode" at the server and the field service technician can install the tracking devices at the location by simply turning it on to activate it (501). After activation the tracking device immediately reports to the server (502). The server checks to see if the tracking device has been assigned to a home location (503). If the tracking device has already been assigned to a home location, then the tracking device has previously been installed and install mode is not processed. The server may then either check to see if the tracking device is in service mode and/or the server may process any activation alerts (504). Otherwise, the tracking device has not been assigned to a home location and the server proceeds with install mode processing. The server first checks to see if the tracking device is reporting a GPS or other precise position from within a location's pre-defined boundary that has been set to the install mode (506). If the tracking device is not reporting a GPS or other precise position from within the boundary of a location that is set up to install new devices, the server waits until the tracking device is brought within such a boundary. Once that happens, install mode processing is initiated to associate the tracking device with the location. The sever waits until a set of pre-defined criteria has been met, indicating that the install process is complete (507). After the install process is completed, the server may send install complete alerts to the field service technician, to other users, or to the tracking device itself to light up an LED (508).

In install mode, the server will receive data from the tracking device, including its GPS position data derived by tracking GPS satellites and determine if the GPS location is within the boundary of the fixed location to be associated with the tracking device. The server will then "install" the tracking device to that fixed location. By "installing" the tracking device to the location the server sets that install location as the tracking device's home location and uniquely assigns the tracking device to a group so that the tracking device inherits the properties of that group including regional law-enforcement jurisdiction and owner bank security (if previously established). While the tracking device is being installed, it will not trigger an alert for law enforcement personnel but will allow the field service personnel or other technical support individual to monitor the installation and receive install alerts during testing of the tracking device. The install mode works within a pre-defined boundary set at the server and when a precise location is available within the boundary and predefined criteria are determined to be met by the server, the tracking device is associated with the location and it is considered "installed." Predefined criteria may include but are not limited to any combination of: certain GPS performance criteria such as RAIM check, certain number of GPS or precise locations and/or accuracy thereof, battery level, on board self test complete, real time clock set, or TCXO calibrated and within a certain range. Once the "install" is complete, install alerts are sent. These alerts may include but are not limited to any combination of: "install complete" text messages sent to the installer via cell phone or pager specifying the tracking device number that is complete, a text message sent to the tracking device causing the "install complete" LED to come on indicating this tracking device is complete. In addition, an "install complete" superscript or other text or graphic identifier may be displayed on a web page to indicate a specific tracking device is install complete. After all of the tracking devices associated with a location have been installed, the location is taken out of the install mode and any subsequent activation will trigger the operational alert system to alert law enforcement associated with a group with that location. A major advantage of this install mode of the system is that the installer does not have to use a tracking device pre-determined to be assigned to a given location. Therefore, it provides flexibility and eliminates installation mistakes where a pre-assigned tracking device may get installed to the wrong location. Additionally, the system is designed such that any number of locations may be set to have tracking devices installed at once and the tracking devices can all be installed automatically over the same period of time in the different locations without any human intervention. The system is also designed such that if a tracking device that has already been assigned a home location passes through a location that is being installed it will continue to operate normally and will not be assigned to that location and will not report alert. The install process also allows an end-to-end test of the system with the device in-the-loop, and if a problem with the tracking device is found (as happens in a small fraction of cases) it can be set-aside for servicing and another tracking device installed in its place. This limits the number of return visits of the service personnel to a given location, saving both time and operational costs.

Figure 6:
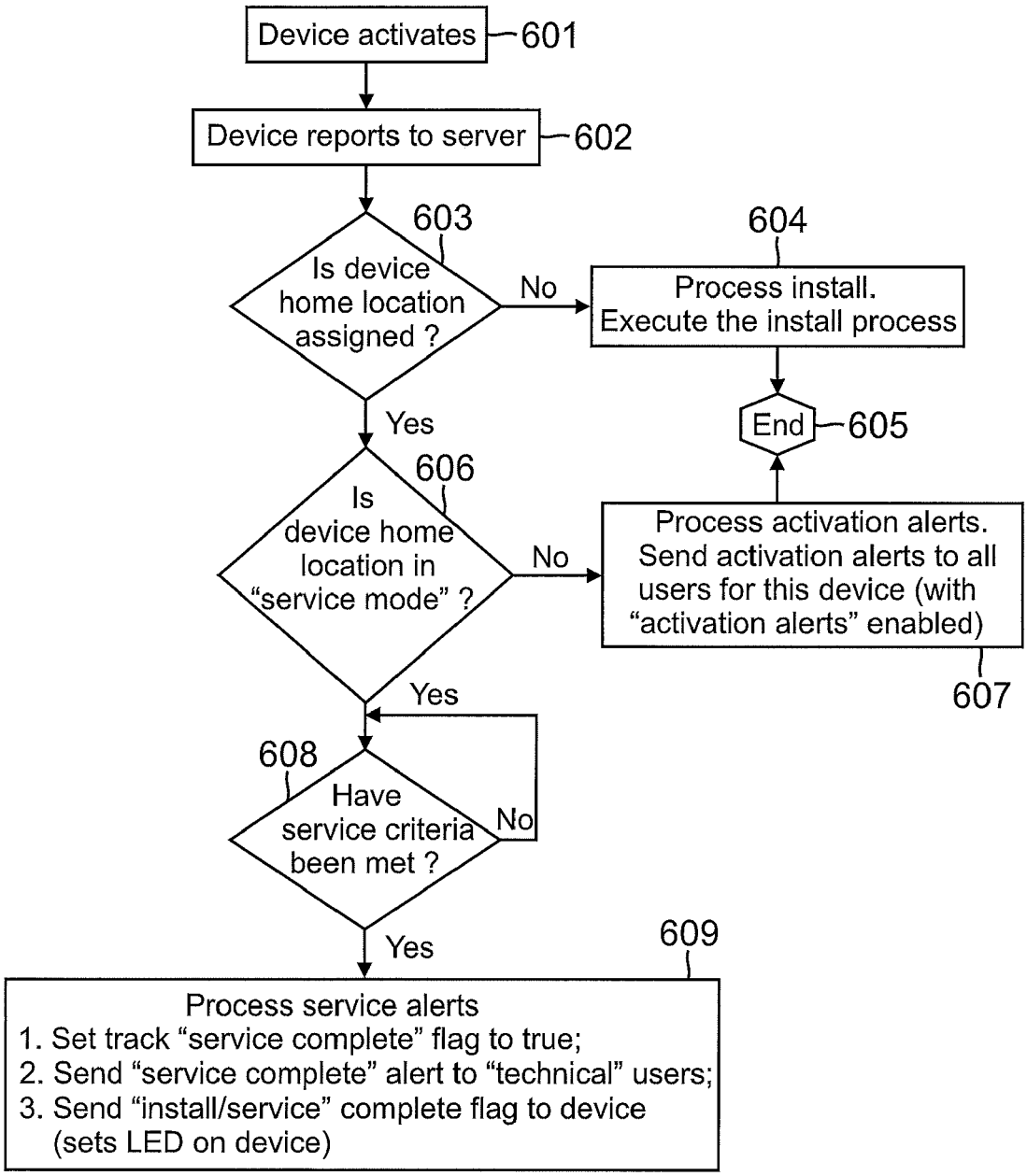
FIG. 6 is a flowchart illustrating the "service mode" logic according to one or more exemplary embodiments of the present disclosure.

Referring to FIG. 6, a flow chart is provided for a method of allowing field service technician to service a tracking device (examples: replace battery, repair the device, or replace the tracking device) without alerting security or law enforcement personnel. A "service mode" setting can be set in the server for a given location. This allows the field service technician to check for performance and test the generation of "servicing" alerts for any tracking device at this location but not alert the security or law enforcement personnel as in the case of a theft/robbery. Service mode also allows for end-to-end testing of the system to include the individual tracking device without unnecessary interruption of security or law enforcement personnel. Upon activation of the tracking device (601), the tracking device reports through the network to the server (602). The server checks to see if the tracking device has been assigned to a home location (603). If the tracking device has not been assigned to a home location, then the tracking device has not been installed and an install mode is processed (604). Otherwise, if the tracking device is associated with a home location, the server checks to see if the home location is set to the service mode (606). If the device home location is not assigned or the device home location is not set to service mode, the server will process a normal activation for the tracking device (607). Otherwise, the home location is set to service mode and service mode processing is initiated. The sever waits until a set of pre-defined criteria has been met, indicating that the service process is complete (608). Once service process is completed, the server issues the service completion alerts (609). The pre-defined service completion criteria can include but are not limited to any combination of: battery voltage is above a certain value, the tracking device has received aiding and set its real time clock, a TCXO has been calibrated and is within an acceptable range, onboard self test is passed, or the tracking device has a specified version of firmware. The service alerts can include but are not limited to any combination of: text messages to the service technician's phone or pager indicating "service complete" for the specific tracking device, or a message sent to the tracking device causing the "service complete" LED to turn on, giving a visual indication that the tracking device is complete. In addition, an "install complete" superscript or other text or graphic indicator may be displayed on a web page. An advantage of service mode over install mode processing is that the tracking device does not need a GPS or precise location for the service mode (because it has already been assigned to the location) so the amount of time the tracking device needs to be on is greatly reduced.

To further automate the system, service mode and install mode can be combined into a single "install/service" mode where if a location is set to this mode the server automatically applies install mode criteria if a tracking device is new or has not been assigned to a location yet, or alternatively applies service mode criteria if a tracking device is not new and has already been assigned to a location.

Figure 7:
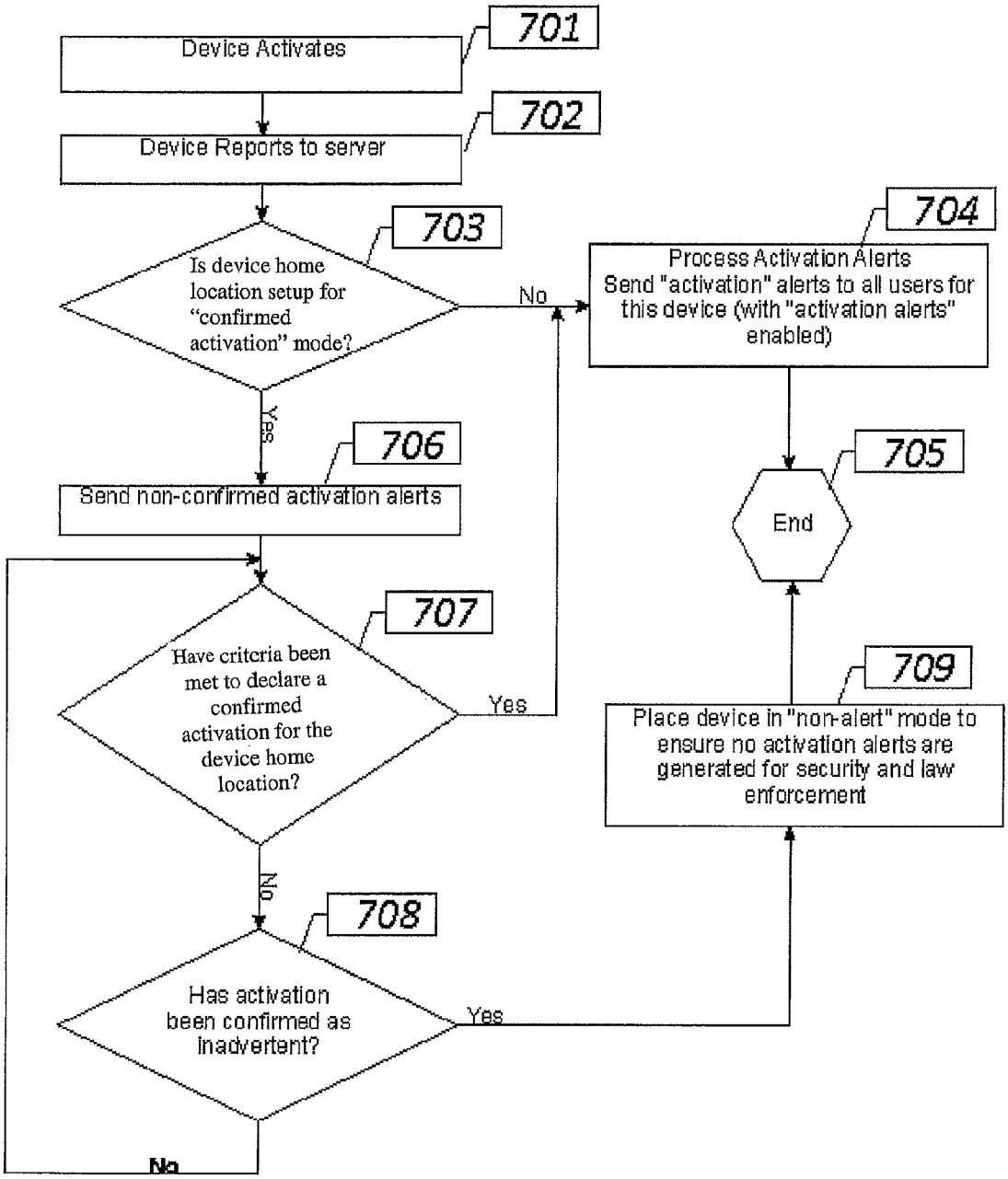
FIG. 7 is a flowchart showing the "confirmed activation mode" logic according to one or more exemplary embodiments of the present disclosure.

Referring to FIG. 7, a flow chart is provided for a method of verifying the robbery status of a tracking device before security or law enforcement individuals receive an alert. This is referred to as the "Confirmed Activation Mode". The tracking device is normally paired with a magnetic plate that holds it in the "off" state and when the tracking device is removed from the plate it is activated or turned "on" (701). The tracking device can also be activated in other ways. For example, the tracking device may be activated by a means of an over-the-door RF field that the tracking device detects to begin reporting to the server. Another activation alternative is for the tracking device to be off while within a RF field and when the tracking device senses that it is no longer within the RF field it activates. Once activated, the tracking device will send data, including its GPS position data derived by tracking GPS satellites, to the server (702). At the server a location or a series of locations would be selected for "confirmed activation" mode of the location. After receiving a report from the activated tracking device, the server would check to see if the home location associated with the reporting tracking device is set to the confirmed activation mode (703). If confirmed activation mode is set for the given location, prior to sending a robbery alert to security or law enforcement personnel, the server sends a non-confirmed activation alert to service personnel (at a monitoring company or similar service group) to verify that an actual robbery is taking place (706). In the case where an actual robbery has occurred, the confirmed activation mode may be manually disabled at the server and a normal robbery alert will then be sent to security and law enforcement personnel (704). Alternatively (and the preferred approach), the confirmed activation mode may be automatically disabled at the server and a normal robbery alert sent to security and law enforcement personnel if a set of criteria has been met to declare a confirmed activation for the device home location (707). In the case of an inadvertent activation, the alert can be manually cancelled and no alert would go to security or law enforcement (709).

The implementation of the "confirmed activation mode" effectively allows multiple levels of alerting based on whether the location is associated with "confirmed alerting" or not. If the location is not associated with confirmed alerting, then all users assigned to receive alerts on tracking device activation receive alerts as they are appropriate. If the location is associated with confirmed alerting, any user that is configured for confirmed alerting will not receive any alerts until the "activation mode" associated with that location is set to "confirmed activation". Once a location is set to confirmed activation, a user configured for "confirmed alerting" will receive alerts from any tracking device with a home location set to that location regardless of the parameters of that individual device (this is unlike traditional geofencing where the alert is based on actions of a specific device). Any event or combination of events can automatically cause a location to be set to confirmed activation. Events that may cause a location to be automatically set to confirmed activation include but are not limited to any combination of: if any tracking device associated with that location has a precise location outside of a predefined area or polygon (as supplied by GPS or equal or better accuracy), if any tracking device associated with that location has been active for N minutes (where N is nominally 5 minutes), or any O number of tracking devices associated with that location are active together for M minutes (where O is nominally <N and M>1).

The various methods of the present disclosure allow for minimum non-emergency interruption of a secondary-alert individuals (police, law enforcement), while allowing others in the system to be made aware of the operational status of tracking device. They make the tracking system more useful and less susceptible to distractions for the various users of the system. This is accomplished through a number of automated methods and processes that allow for the highest flexibility while limiting extraneous information.

Although exemplary embodiments of the present disclosure have been described, the exemplary embodiments illustrate, but do not limit the disclosure. It should be understood that embodiments of the present disclosure should not be limited to these exemplary embodiments but numerous modifications and variations may be made by one of ordinary skill in the art and be included within the spirit and scope of the present disclosure as hereinafter claimed.

What is claimed is:

1. A method of selectively providing an alert of a tracked asset in an asset recovery system, the method comprising:

(a) activating a tracking device on the tracked asset to generate a report;

(b) evaluating the report to determine if the tracking device is assigned to a home location;

(c) if the tracking device is not assigned to said home location:

(i) determining a first location of the tracking device;

(ii) updating the first location until the first location is within a pre-defined boundary of a second location that is configured for an install mode;

(iii) verifying that an installation condition is satisfied; and (iv) assigning the second location as the home location of the tracking device.

2. The method of claim 1, wherein said activating the tracking device comprises turning on the tracking device for installation.

3. The method of claim 1, wherein said verifying comprises verifying that the tracking device satisfies a performance criterion.

4. The method of claim 1, wherein the second location is owned by an owner group having an associated property and said assigning results in the tracking device inheriting the associated property from the owner group.

5. The method of claim 1, wherein said activating the tracking device comprises servicing the tracking device, the method further comprising the steps of:

(d) if evaluating the report determines that the tracking device is assigned to a home location and the home location is set for a service mode, further performing the steps of:

(i) verifying that a service condition is satisfied; and (ii) sending a service complete alert to a user enabled to receive the service complete alert.

6. The method of claim 5, wherein the report received from the tracking device does not include current location information.

7. The method of claim 1, wherein said activating the tracking device comprises removing the tracking device from the home location assigned to the tracking device and the method further comprises the steps of:

(d) if said evaluating the report determined that the tracking device is assigned to a home location and that the home location is in a confirmed activation mode, further performing the steps of:

(i) sending a non-confirmed activation alert to a first user enabled to receive the non-confirmed activation alert in a multi-stage alerting mechanism;

(ii) verifying that a confirmed activation condition is satisfied; and (iii) sending a confirmed activation alert to a second user enabled to receive the confirmed activation alert in the multi-stage alerting mechanism.

8. The method of claim 7, wherein said verifying that a confirmed activation condition is satisfied comprises declaring a confirmed activation for the home location so that another tracking device assigned to the home location also sends another alert to the second user.

9. The method of claim 7, wherein the report received from the tracking device comprises a location of the tracking device.

10. The method of claim 1, wherein the user receives the alert through a communication device selected from the group consisting of: a pager, a cell phone, and a personal digital assistant.

11. The method of claim 1, wherein the user receives the alert through an application selected from the group consisting of: a web browser, an e-mail application, an Instant Message client program, and an application or applet running on a computer.

12. The method of claim 1, wherein the user is a person selected from the group consisting of: a field service technician, law enforcement personnel, and a system monitor.

13. The method of claim 1, further comprising the step of:

(c)(v) sending an install complete alert to a user enabled to receive the alert.

14. A system for selectively providing an alert of a tracked asset in an asset recovery system, the system comprising:

a tracking device on the tracked asset adapted to generate a report when the tracking device is activated; and a server configured to receive the report from the tracking device, to confirm if a condition has been satisfied, and to send an alert to a user enabled to received the alert if the condition has been satisfied, the server further programmed to perform the steps of:

evaluating the report to determine whether the tracking device is assigned to a home location, and if the tracking device is not assigned to a home location, performing an install protocol for automatically assigning a home location to the tracking device when the tracking device is located within a home location set to an install mode;

if the tracking device is assigned to a home location, performing a service protocol if the home location is set to a service mode and performing one or more activation protocols if the home location is set to an activation mode.

15. The system of claim 14, wherein the install protocol comprises programmed steps for:

determining a first location of the tracking device based upon location information from the tracking device;

(ii) updating the first location until the first location is within a pre-defined boundary of a second location that is confiured for an install mode;

(iii) verifying that an installation condition is satisfied; and (iv) assigning the second location as the home location of the tracking device.

16. The system of claim 15, wherein the tracking device is further programmed to be activated during the install mode when the tracking device is turned on.

17. The system of claim 15, wherein the server is further programmed to verify that the tracking device satisfies a performance criterion.

18. The system of claim 15, wherein the server is further programmed to assign the tracking device in the install mode to the home location such that the tracking device inherits a property associated with the home location.

19. The system of claim 14, wherein the service protocol includes programming for sending a service complete alert to a user enabled to receive the service complete alert if a service condition has been satisfied.

20. The system of claim 14, wherein the server is programmed to perform a confirmed activation mode protocol if the home location is in a confirmed activation mode, the confirmed activation mode protocol comprising steps for:

sending a non-confirmed activation alert to a first user enabled to receive the non-confirmed activation alert, and if a confirmed activation condition is satisfied, sending a confirmed activation alert to a second user enabled to receive the confirmed activation alert.

21. The system of claim 20, wherein the server is further programmed to perform a confirmed-activation-mode-disabled protocol if the confirmed activation mode is disabled, the confirmed-activation-mode-disabled protocol comprising steps for:

sending an activation alert to the second user without first sending the non-confirmed activation alert to the first user.

22. A method for selectively providing an alert of a tracked asset in an asset recovery system, the method comprising:

activating a tracking device on the tracked asset;

generating a report;

evaluating the report to determine if the tracking device is assigned to a home location;

if the tracking device is not assigned to a home location, performing an install protocol for automatically assigning a home location to the tracking device when the tracking device is located within a home location set to an install mode; and if the tracking device is assigned to a home location, performing a service protocol if the home location is set to a service mode and performing one or more activation protocols if the home location is set to an activation mode;

each of the install protocol, service protocol, and one or more activation protocols comprising the steps of confirming if a condition has been satisfied sending an alert to a user enabled to received the alert if the condition has been satisfied.

23. The method of claim 15, wherein the install protocol comprises programmed steps for:

(v) sending an install complete alert to a user enabled to receive the alert.

* * * * *